United States Patent [19]

Poletto

[11] Patent Number: 4,863,479

[45] **Date of Patent: * Sep. 5, 1989**

[54] PROCESS FOR OBTAINING SYNTHETIC HIDES SIMILAR TO NATURAL HIDES BY A CHEMICAL TREATMENT OF SYNTHETIC SHEET MATERIAL

[75] Inventor: Giorgio Poletto, Cirie', Italy

[73] Assignee: Lorica S.p.A., Torinese, Italy

[ * ] Notice: The portion of the term of this patent subsequent to Aug. 23, 2005 has been disclaimed.

[21] Appl. No.: 208,164

[22] Filed: Jun. 16, 1988

[30] Foreign Application Priority Data

Jun. 19, 1987 [IT] Italy ..... 67535 A/87

[51] Int. Cl.[4] ..... D06M 15/00

[52] U.S. Cl. ..... 8/115.56; 8/436; 8/515; 427/242; 427/245

[58] Field of Search ..... 8/115.6, 436, 515, 94.19 R, 8/94.23, 115.56, 115.54; 428/904; 427/245, 246, 242, 400; 521/53

[56] References Cited

U.S. PATENT DOCUMENTS 4,766,014 8/1988 Poletto ..... 427/400

*Primary Examiner*—Paul Lieberman
*Assistant Examiner*—John F. McNally
*Attorney, Agent, or Firm*—Michael N. Meller

[57] ABSTRACT

An improved process is described for obtaining synthetic hides similar to natural hides by application, to a composite sheet material formed of a porous polymeric matrix within which are embedded fibres, preferably polyamides, of a tanning phase entirely similar to that utilized on natural hides, followed by a treatment with an aqueous solution of a di- or polyaldehide and by a stuffing phase, also entirely similar to that utilized on natural hides; the improved principle consists in effecting, between the tanning phase and the treatment with the di- or polyaldehide, a filling phase in which synthetic polymeric resins mixed with synthetic and/or natural tannins are introduced and fixed into the porous matrix.

11 Claims, No Drawings

PROCESS FOR OBTAINING SYNTHETIC HIDES SIMILAR TO NATURAL HIDES BY A CHEMICAL TREATMENT OF SYNTHETIC SHEET MATERIAL

BACKGROUND OF THE INVENTION

The present invention relates to an improved process for obtaining synthetic hides similar to natural hides by means of a chemical treatment of sheet synthetic material, and in particular by treatment of a commercially known raw material made available by KURARAY CO LTD both in its raw state and as a finished product under the name SOFRINA (registered trade mark) comprising a porous expanded polyurethane matrix in which are embedded fibres of NYLON (registered trade mark) or other types of polyamide fibres or non-woven fabric, and a covering skin made from a layer of compact polyurethane embossed in an imitation of the form of the natural hide which it is desired to imitate. More particularly the present invention relates to improvements in the similar process described in Italian Patent application No. 67585-A/84 filed on 6 June 1984 and entitled: "A process for obtaining synthetic hides similar to natural hides by a chemical treatment of sheet synthetic materials", the content of which is incorporated hereby by reference.

In the said earlier Patent application there is described a chemical treatment which surprisingly permits a porous synthetic material constituting a second rate imitation of natural leather, in that it is substantially lacking the consistency such as to give to the touch that typical sensation of natural leather, the so-called "handle" to those skilled in the art, to be transformed into a perfect imitation of natural leather almost indistinguishable by touch even to an expert; this treatment consists in subjecting a flexible porous synthetic sheet material, preferably having fibres freely embedded in the matrix and provided at the surface, on one of its faces, with a compact layer of worked plastics resin, for example stamped, in imitation of the configuration of the type of leather to be imitated, to a treatment entirely similar to the tanning treatment to which natural hide is subjected, then followed by a stuffing treatment again entirely identical to that which is performed on natural leather after tanning. The application both of the tanning treatment, which as is known serves only the purpose of making the natural collagen fibres which impart to the leather its well known properties, resistant to putrescence, and of the subsequent stuffing treatment, to a porous synthetic material which is not decomposable and which does not even have a chemical composition able to react with the substances utilised for tanning (usually metallic salts such as sulphates and chlorates) must have appeared absurd both to the tanning specialist and to the organic chemist; however, according to the process described in the above-mentioned Patent application, it is surprisingly found that the salts of the tanning solution can be precipitated within the pores of the synthetic material being treated, where they are then retained and where they subsequently contribute to the retention in a stable manner of the stuffing substances, producing a considerable increase in weight, volume and consistency of the original material, and imparting thereto, in an entirely unexpected manner, just that "handle" and the typical aspect of natural leathers. Still on the basis of the process of the above-mentioned prior Patent application, the flexibility of the starting material can be improved, even in this case approaching that of the best leather, by means of an additional "pseudo-tanning" treatment of the material before the stuffing thereof, with an aqueous solution containing a di- or polyaldehyde.

In reality, however, natural leather, depending on the type (sheep, cattle, horse, etc) of animal from which it is obtained, has different characteristics of flexibility and consistency, which in practice make one type preferable for a certain use (for example for the manufacture of soles of shoes) and another type for a different use (for example for the manufacture of shoe uppers, clothes, handbags etc); now, with the known process the subject of the said patent application it is not possible to obtain this difference in flexibility between the different types of synthetic leathers produced. In other words, starting from identical materials, but one of which, for example, has a surface configuration in imitation of calf leather, and another has a surface configuration, on the other hand, in imitation of horse leather, two final artificial hides are obtained which differ only in their external aspect but which, however, have substantially the same flexibility, unlike the respective natural leathers which they imitate.

SUMMARY OF THE INVENTION

The object of the invention is that of providing an improved process for obtaining synthetic hides similar to natural hides by means of a chemical treatment of sheet synthetic material, entirely similar to that described in the first mentioned Italian Patent application, but free from the described disadvantage, in particular incorporating an additional phase which permits different flexibilities to be obtained whilst the other characteristics remain identical.

The said object is achieved by the invention which relates to an improved process for obtaining synthetic hides similar to natural hides by means of a chemical treatment of a porous, flexible sheet synthetic material, the process comprising at least a first phase in which the said porous synthetic material is treated with an aqueous solution of metallic salts of the type normally used in known tanning processes, and a second phase in which the material treated with the tanning solution is subjected to a stuffing process substantially identical to the known stuffing process to which natural leather is subjected, characterised by the fact that between the said first and second phases the said porous material treated with the tanning solution is subjected to a filling phase in which a mixture of at least one synthetic plastics resin with synthetic and/or natural tannins is introduced into the pores thereof.

DETAILED DESCRIPTION OF THE INVENTION

In substance the Applicant has surprisingly discovered, after numerous experimental tests, that it is possible to obtain synthetic products entirely similar to natural hides and having different flexibilities with a single process substantially comprising that already described in Italian Patent application No. 67585-A/84 filed on 6 June 1984 and entitled: "A process for obtaining synthetic hides similar to natural hides by means of a chemical treatment of sheet synthetic materials", the content of which is integrally incorporated into the present description by reference, but varied in such a way as to introduce, between a first "pseudo tanning" phase of this process in which the porous flexible synthetic sheet starting material is treated with an aqueous solution of metallic salts of the type normally used in known tanning processes, and a second phase of this process, in which the material treated with the tanning solution is subjected to a stuffing process substantially identical with the known suffing process to which natural leather is subjected, an intermediate filling phase in which the pores of the porous material treated with the tanning solution have a mixture of at least one synthetic plastics resin of any type, but preferably acrylic, with synthetic and/or natural tannins introduced into them. The terms "tannin" or "tannins" generally indicate, as is known, that class of substances both of natural origin (for example contained in acorn oil, grape stalks etc) and synthetic origin, which are the derivatives of tannic acid which, in turn, as is well known, is not a substance of defined formula, but rather a mixture of substances such as esters of alcohols and aromatic acids and glucose, such as pyrocatechol, isocatechol, penta-digallic-glucose, etc. Tannins are normally used for the vegetable tanning of natural leather instead of (or in combination with) tanning processes with metallic salts, such as for example chrome tanning, in that they are able to attack the organic structure of the collagen fibres preventing them from putrefying; their use on a non-putrefiable material, for the most part in combination with a filling substance such as a synthetic plastics resin and subsequently with a tanning solution of metallic salts is therefore absurd both in the eyes of the tanning expert and in the eyes of the organic chemist since the tannins cannot react with polymers of stable structure such as polyurethanes and polyesters, or with the polyamide fibres present in the synthetic sheet material which, according to the invention, is selected to be subjected to the chemical treatment. However, the applicant has unexpectedly established that the treatment of a porous synthetic sheet material with tannins mixed with polymeric resins able to deposit on the interior of the pores of the treated material, subsequent to a treatment with a pseudo-tanning solution of metallic salts and before the stuffing treatment, above all, to a further treatment with a di- or polyaldehyde according to a further phase of the process the subject of Italian Patent application No. 67585-A/84 mentioned above and to which reference is made for the parts not specifically described here, makes it possible to obtain, depending on the conditions in which it is conducted, and in particular in dependence on the composition of the tannin-resin mixture, different characteristics of rigidity from the same starting material with the result that depending on the natural material to be imitated one can impart to the artificial material resulting from the process of the invention a different flexibility and, what is more, the greatest possible similarity to that of the material imitated; if it is desired to imitate, for example, a horse leather, notoriously more rigid and used to make the soles of shoes, one can, by means of the process of the invention and starting from a porous synthetic material provided with a surface skin configured to imitate horse leather, obtain a final product of high rigidity; vice versa, a starting material worked in such a way as to imitate kid leather can be treated in such a way as to obtain the maximum softness, and so on.

In particular, the said additional filling phase, which is the principal characteristic of the improved process according to the invention with respect to the similar known process the subject of the said Italian Patent application, is performed by treating the said porous material with an aqueous solution of 4–16%, by weight, of the weight of the raw material of tannin and emulsified synthetic resin. The synthetic starting material, usually available in strips of length of about ten meters, can equally well be tied in bales and treated in rotating tubs of the same type as are used for tanning natural leather, as described in the said Patent application No. 67585-A/84 or else, in another improved aspect of the present invention, can be wound in such a way as to form at least one closed loop and subsequently treated by recirculation within a fulling mill of the same type as textile machines having jets used for dying cord textiles, in other words surprisingly utilising an essentially textile apparatus for an essentially tanning process. The treatment with di- or polyaldehyde is performed in an aqueous solution of 5–10% by weight of the weight of the raw material of di- or polyaldehide, and this, in a further improvement of the invention, is preferably chosen from the group comprising: aspartic aldehyde, glutaric aldehyde, pyruvic aldehyde, crotonic aldehyde, 2-ethyl-butyric aldehyde.

Although any synthetic sheet material, as long as it is porous and provided with a compact surface skin imitating the animal skin must be considered to be suitable to be utilised in the process according to the invention in that the chemical nature of the material, as long as it is not incompatible with that of the chemical treatment solutions utilised, does not seem to be critical, the material with which the best results are obtained comprises a porous matrix made of congealed expanded polyurethane, in which is embedded a fibrous reinforcement formed of non-woven fabric and/or fibres chosen from the group comprising fibres of polyester, polyamide or polyethylene and a covering layer over a face of the matrix made of compact polyurethane embossed in such a way as to retain an impression of a surface configuration similar to that of the natural hide to be imitated; in the first pseudo-tanning phase the porous material is treated with an aqueous solution of from 15–45% by weight of at least a metal salt chosen from the group comprising calcium sulphate, sulphate of Cr, Fe, Al, Mg or Ti and chlorate of Cr, Fe, Al, Mg or Ti; in the stuffing phase the porous material is treated with an emulsion in water of oils chosen from the group comprising mineral oil, sulphurated whale oil and esters of substituted or non-substituted fatty acids having from 12 to 24 carbon atoms. After the stuffing phase the porous sheet material is dyed by means of a mixture of at least one dyeing metal complex for polyurethane with at least one pre-metallised dye for polyamide fibres (NYLON), especially if this starting material consists of the raw synthetic leather produced by KURARAY CO LTD and also made commercially available in finished version (in other words dyed and worked with finishers) with the name SOFRINA, which has been determined to consist of a polyurethane matrix having fibres of nylon or other polyamide fibres embedded therein.

According to the invention, in the filling phase the porous material is treated with an emulsion of from 2% to 7% by weight of the raw material of a resin chosen from the group consisting of acrylic resins and styrene-maleic resins mixed with from 2 to 10% by weight of raw tannin based tanning or pre-tanning materials. If it is desired to obtain a material of medium rigidity, the porous sheet material is treated with a solution of 2% by weight of a commercial tanning agent based on dicyandiamide formaldehide, with an emulsion of 4% of an acrylic resin and with a solution of 3% by weight of commercial synthetic tannin mixed together until they permeate substantially all the pores thereof; subsequently HCl is added to the mixture to bring the pH of the solution to a value lying between 4 and 4.5, in such a way as to cause precipitation of the said acrylic resin directly within the pores of the porous sheet material. To obtain rigid final products, on the other hand, during the filling phase the porous sheet material is treated with a solution of 10% by weight of a commercial tanning mixture of synthetic tannins and chrome oxide, with an emulsion of 2% of an acrylic resin and with a solution of 3% by weight of a synthetic tanning mixture in phenol (phenolic based synthetic tannin), mixed together, and subsequently subjected to a drying phase. In conclusion, by varying at will the composition of the filling solution, in particular its composition of tannins and resin, it is found that one can obtain different rigidity of the final material so that the expert in the art can easily obtain in practice a desired rigidity for the different types of final product by experimenting with different mixtures of tanning agents for the tannin and filling resins commonly commercially available.

The invention will now be described with a series of non-limitative examples.

EXAMPLE 1

Twenty-four strips of about ten meters in length, each of a porous flexible synthetic commercially available raw material produced by KURARAY LTD, formed by an expanded polyurethane matrix with polyamide fibres embedded therein, and a surface skin or covering layer formed of compact polyurethane embossed in imitation of an animal skin configuration are subdivided into two lots each of twelve strips; the first twelve strips are folded and tied in bales of 250×120×120 centimeters and introduced into a rotating tanning tub of about 5.6 cubic meters in volume; the other twelve strips are each sewn in a loop and are introduced into a known jet type textile dyeing machine; such machines are used for washing and dyeing textiles, are also commonly called "fullers", and essentially comprise a closed container provided with a lower basin and with various facing annular ducts in which the textile loops recirculate, which ducts are connected to the basin and provided with nozzles for the introduction of water, air and washing solutions, which can collect in the basin, from which they are recirculated by the pumps; in such a dyeing machine the twelve strips of raw material are introduced in place of the fabric strips and recirculated by the action of appropriate rollers. After having loaded the strips of material into the two machines these are subjected to the same washing process by introducing into the two machines the same substances, in the same quantities and for the same times. First, the strips are treated for about twenty minutes with 650 liters of a solution of water at 60° C. mixed with a surfactant; subsequently the strips are treated for forty minutes with 650 liters of a tanning solution of 39% by weight chrome sulphate, maintained at 60° C. and at a pH of about 3.2; at the end of the forty minutes the pH of the tanning solution is raised by the addition of NaOH 10N to a value of 7.1 precipitating chrome hydroxide; after washing with water to remove the excess flocculated hydroxide on the surface of the strips these are treated with 650 liters of an aqueous emulsion containing, calculated by weight on the weight of raw material used, 7% of APRITAN PQ (registered trade mark), known styrene-maleic filling resin utilised in tanning on natural skins, 3% of TANIGAN PAK (registered trade mark) and 2% of BASITAN MN (registered trade mark) all known resin tanning agents utilised in tanning and containing mixtures of synthetic tannins and styrene-maleic resins; the treatment is conducted at 50° C. and lasts for sixty minutes; finally the strips are treated with 650 liters of aqueous solution of glutaric aldehide at 6% by weight calculated on the weight of raw material (that is on the weight of the strips) for forty-two minutes, then stuffed by a treatment for forty-five minutes at 65° C. with 650 liters of an aqueous emulsion of castor oil at 20% by weight, and finally dyed with a mixture constituted by an aqueous solution at 3% by weight of BASACRIL (registered trade mark), a known dye for polyurethanes and 3% by weight of ISOLAN (registered trade mark) a known specific dye for polyamide fibres. For fireproofing purposes the strips are then treated for thirty minutes with an aqueous solution at 60% by weight of PIROFLAM (registered trade mark), a known fire retardent and, subsequently, for fifteen minutes with an aqueous solution at 30% by weight of PIROFLAM and 20% by weight of TRIANOL SP (registered trade mark) a known softening agent based on Laurates, both of 255 liters and finally dried with hot air at 60° C. When removed the worked strips have a weight and thickness which is greater than those of the starting materials, an appearance and handle identical to those of natural leather and a great softness and flexibility. Twenty samples of 20×20 cm taken from each lot of strips of treated material are compared with twenty identical samples of natural tanned leather; the results are set out in table 1, from which it can be deduced, in the first place, that the treatment in tanning tubs or in textile jet dying machines or the like provides substantially identical results and in the second place that the final product is entirely equivalent to natural leather.

TABLE 1

| | | Raw Kuraray | |
|---|---|---|---|
| | Natural Leather | Tub Treatment | Jet Treatment |
| Resistance to Tension | G | E | E |
| Resistance to Abrasion | G | G | G |
| Resistance to Folding | G | G | G |

(E = Excellent; G = Good; P = Poor)

EXAMPLE 2

Operating exactly as in Example 1 the treatment conditions of the material between the phases of treatment with the tanning solution and treatment with the gultaraldehyde are varied by utilising different mixtures of synthetic plastics filling resins and different tannins. In particular there is first used an aqueous emulsion (percentages by weight calculated on the weight of the raw material to be treated) comprising 2% of RETIGAN R4B (registered trade mark) a known tanning agent based on dicyandiamide formaldehyde, 4% of RETIGAN R7 (registered trade mark) a known filler for tanning based on acrylic resin, and 3% of TANIGAN CK (registered trade mark) another known pre-tanning agent based on synthetic tannin; 250 liters of this emulsion at 30° C. are introduced in one case into the tub and in the other into the jet dying machine and the strips are worked for sixty minutes, then the pH of the emulsion is lowered to about 4.1 by adding HCL 1N causing precipitation of the resin; it is observed that this precipitates also within the interior of the pores of the material where it remains trapped providing a final flexible material, but more rigid than that obtained in Example 1.

In the same way, another twenty-four strips of material are treated as above utilising, however, an aqueous emulsion of resin and tannins of different composition, in particular containing only 2% of RETIGAN R7 acrylic resin and containing, in place of the said tanning agent 10% of TANIGAN CU (registered trade mark) another type of tanning agent constituted by a mixture of synthetic tannin and chrome oxide, and 3% of TANIGAN BN, a solution of phenol based synthetic tannin, that is containing tannins mixed in phenol. A flexible final material is obtained of identical aspect to natural leather of the more rigid type, however having high rigidity, very much greater than that of the products treated with the preceding methods.

EXAMPLE 3

By operating as in Example 1, but only in tubs, strips of a different starting material are treated, having different thickness and a fibre content of different nature, or else free from fibres embedded in the polyurethane matrix, which are formed of porous polyurethane chemically coagulated in a known way; the types of material used are indicated in Table 2; the oils which are used are as follows:

1-Sulphurated whale oil (sperm oil)

2-Castor oil

3-Oil B, which is a mixture of 50% by weight of oleic acid and 50% by weight of palmitic acid to which 30% by weight of polyethylene glycol has been added 4-Cr-soap, that is a mixture of stearic acid saponified with chrome salts 5-Oil D, which is a mixture of fatty acids having from 12 to 24 carbon atoms esterified with glycerine 6-mineral oil Table 3 indicates the process conditions, indicated with A, B and C the type of treatment with tannins and plastic filling resins utilised; A corresponds to the treatment of Example 1, B and C to that of Example 2. In all cases the final product was extraordinarily similar to natural leather and had different rigidity according to the treatment with tannins and the resin utilised.

TABLE 2

| Material | Description of the Material | Thickness |
|---|---|---|
| A | Same as example 1 | 0.8 mm |
| B | Polyurethane matrix plus non-woven fabric | 1.1 mm |
| C | Polyurethane alone without fibres | 0.5 mm |
| D | Polyurethane matrix plus polyester fibres | 0.9 mm |
| E | " | 2 mm |
| F | " | 1.2 mm |
| G | Polyurethane matrix plus polyethylene fibres | 0.3 mm |
| H | " | 2 mm |
| I | " | 1.2 mm |

TABLE 3

| | Tanning Solution | | Solution | Solution of aldehides | | Oil | |
|---|---|---|---|---|---|---|---|
| Material | Type | % | of Tannins | Type | % | Type | % |
| A | 1 | 45 | A | 1 | 7 | 1 | 25 |
| B | 3 | 20 | A | 1 | 5 | 2 | 30 |
| C | 2 | 25 | B | 2 | 10 | 3 | 27 |
| D | 4 | 30 | C | 4 | 8 | 5 | 28 |
| E | 5 | 35 | B | 5 | 9 | 4 | 29 |
| F | 7 | 40 | C | 3 | 6 | 6 | 25 |
| G | 8 | 38 | A | 5 | 10 | 1 | 30 |

TABLE 3-continued

| | Tanning Solution | | Solution | Solution of aldehides | | Oil | |
|---|---|---|---|---|---|---|---|
| Material | Type | % | of Tannins | Type | % | Type | % |
| H | 6 | 28 | B | 4 | 8 | 3 | 30 |
| I | 5 | 30 | C | 3 | 5 | 2 | 18 |

Tanning solutions: 1-Ca sulphate; 2-Al sulphate; 3-Mg sulphate; 4-Ti sulphate; 5-Cr sulphate; 6-Al chlorate; 7-Mg chlorate; 8-Cr chlorate.

Aldehyde solutions: 1-glutaric; 2-pyruvic; 3-crotonic; 4-aspartic; 5-2-ethyl butyric

I claim:

1. A process for producing synthetic hides similar to natural hides by a chemical treatment of material comprising a porous expanded polyurethane matrix comprising in sequence the steps of (a) treating said material with an aqueous solution containing at least one metal salt selected from the group consisting of the sulfates of calcium, chromium, iron, aluminum, magnesium and titanium and the chlorides of chromium, iron, aluminum, magnesium and titanium until said material is saturated by said solutin;

(b) treating the material produced in step (a); with a mixture of at least one synthetic plastics resin with synthetic tannins or natural tannins or combinations thereof to introduce said tannins into the pores thereof;

(c) treating the material produced in step (b) with an aqueous emulsion of fatty material selected from the group consisting of mineral oil, sulfated sperm oil and esters of substituted or unsubstituted fatty acids having from 12 to 24 carbon atoms.

2. A process according to claim 1, characterised by the fact that the said filling phase is effected by treating the said porous material with an aqueous solution of 4–16% by weight, with respect to the weight of the raw material, of tannin and emulsified synthetic resin.

3. A process according to claim 1, characterised by the fact that the said porous sheet material is tied into bales and treated in a rotating tub of the same type as that used for the tanning of natural leather.

4. A process according to claim 1, characterised by the fact that the said porous sheet material is wound in such a way as to form at least one closed loop and is treated by recirculation within the interior of a fuller of the same type as the textile jet machine employed for dyeing cord textiles.

5. A process according to claim 1, characterised by the fact that after the said filling phase and before the said second phase, the said porous treated material is further treated with an aqueous solution of 5–10% by weight, with respect to the weight of raw material, of a di- or polyaldehyde, preferably chosen from the group comprising: aspartic aldehyde, glutaric aldehyde, pyruvic aldehide, crotonic aldehide, 2-ethyl-butyric aldehyde.

6. A process according to claim 1, characterised by the fact that the said porous sheet material to be treated comprises a porous matrix of coagulated expanded polyurethane, and a covering layer made of compact polyurethane embossed in such a way as to carry impressions similar to that of the natural hide to be imitated, in the said porous matrix there being embedded a fibrous reinforcement formed by non-woven fabric and/or fibres chosen from the group comprising polyester fibres, polyamide fibres and polyethylene fibres.

7. A process according to claim 1, characterised by the fact that in the said first phase the said porous material is treated with an aqueous solution of 15–45% by weight of at least one metallic salt chosen from the group consisting of calcium sulphate, Cr sulphate, Fe sulphate, Al sulphate, Mg sulphate, Ti sulphate and Cr chlorate, Fe chlorate, Al chlorate, Mg chlorate, Ti chlorate; and by the fact that in the said second phase the said porous material is treated with an emulsion in water of oils chosen from the group consisting of mineral oil, sulphurated whale oil, castor oil and esters of substituted or non-substituted fatty acids having from 12 to 24 carbon atoms.

8. A process according to claim 1, characterised by the fact that after the stuffing phase the said porous sheet material is dyed by means of a mixture of at least one metal complex dye for polyurethane with at least one pre-metallised dye for polyamide fibres.

9. A process according to claim 1, characterised by the fact that in the said filling phase the said porous material is treated with an emulsion of from 2% to 7% by weight, with reference to the weight of raw material, of a resin chosen from the group comprising acrylic resins and styrene-maleic resins mixed with from 2 to 10% by weight, with reference to the weight of raw material, of tannin based tanning or pre-tanning agents.

10. A process according to claim 9, characterised by the fact that in the said filling phase the said porous sheet material is treated with a solution of 2% by weight of a tanning agent based on dicyanodiamide formaldehyde, with an emulsion of 4% of an acrylic resin and with a solution of 3% by weight of synthetic tannin mixed together until they permeate substantially all the pores thereof, and by the fact that, subsequently, HCl is added to the mixture to bring the pH of the solution to a value lying between 4 and 4.5 in such a way as to cause precipitation of the said acrylic resin directly in the pores of the said porous sheet material.

11. A process according to claim 9, characterised by the fact that in the said filling phase the said porous sheet material is treated with a solution of 10% by weight of a tanning mixture of synthetic tannins and chrome oxide, with an emulsion of 2% of an acrylic resin and with a solution of 3% by weight of a mixture of synthetic tannins in phenol, mixed together, and subsequently subjected to a drying phase.

* * * * *